United States Patent [19]

Moon et al.

[11] Patent Number: 5,054,468

[45] Date of Patent: Oct. 8, 1991

[54] UNVENTED GAS-FIRED FIREPLACE HEATER

[75] Inventors: W. Larry Moon, Russellville; Paul N. Hand, Tuscumbia, both of Ala.

[73] Assignee: Martin Industries, Inc., Florence, Ala.

[21] Appl. No.: 498,023

[22] Filed: Mar. 23, 1990

[51] Int. Cl.[5] ..... F24C 3/00

[52] U.S. Cl. ..... 126/512; 126/531; 126/88

[58] Field of Search ..... 126/523, 528, 529, 531, 126/88, 89, 90 R, 512

[56] References Cited

U.S. PATENT DOCUMENTS

| | | | |
|---|---|---|---|
| 2,696,205 | 12/1954 | Ruhl | 126/92 AC |
| 3,880,139 | 4/1975 | Young | 126/548 |
| 4,271,815 | 6/1981 | Johnson | 126/531 |
| 4,519,376 | 5/1985 | Schoeff et al. | 126/531 |
| 4,793,322 | 12/1988 | Shimek et al. | 126/531 |
| 4,834,064 | 5/1989 | Takashima et al. | 126/523 |

*Primary Examiner*—Carroll B. Dority

*Attorney, Agent, or Firm*—Phillips & Beumer

[57] ABSTRACT

An unvented fireplace heater assembly for directing heated air into an enclosure such as a room. The fireplace heater includes a combustion chamber mounted in spaced relation in enclosing panels. A plenum chamber is disposed in the panels adjacent to the unvented combustion chamber, and insulation may be selectively provided between the panels and the plenum chamber.

7 Claims, 4 Drawing Sheets

UNVENTED GAS-FIRED FIREPLACE HEATER

TECHNICAL FIELD

This invention relates generally to a fireplace heater and more particularly to an unvented fireplace heater requiring substantially zero clearance between the external surfaces thereof and any combustible construction material enclosing the heater.

BACKGROUND OF THE INVENTION

The present invention is directed to an unvented heater which may be installed in the opening of an existing fireplace or in an opening provided in combustible construction materials which are typically used in normal construction of a house or other types of buildings. The heater of the present invention is an unvented heater and has no flues, etc.

In one embodiment of the present invention, the heater may be installed in snug-fitting relation (zero clearance) in an opening of an existing fireplace, in which case no insulation is required between the heater and the fireplace walls.

In another embodiment, the heater may be installed in snug-fitting relation (zero clearance) in an opening provided in the typical combustible material found in a home or other types of buildings, in which case insulation is used between the combustible materials and the heater.

Heat exchangers of various kinds are disclosed in U.S. Pat. Nos. 4,519,376, issued May 28, 1985, to Schoeff et al.; 4,545,360, issued Oct. 8, 1985, to Smith et al.; 4,141,336, issued Feb. 27, 1979, to Fitch; 4,793,322, issued Dec. 27, 1988, to Shimek et al; and 3,168,088, issued Feb. 2, 1965, to Martin et al. All of these heat exchangers are provided with flues which communicate into the combustion chamber to direct combustion products (and heat) away from the internal space, such as a room, etc.

It is, therefore, an object of the present invention to provide an unvented gas-fired fireplace heater which is economical to build and economical to install in newly-built or existing building structures.

It is another object of the present invention to provide an unvented heater which mounts in combustible construction material (sheetrock, etc.) in a rapid and facile manner.

It is a further object of the present invention to provide such a heater which requires substantially zero clearance between its external walls and the existing combustible materials.

SUMMARY OF THE INVENTION

In accordance with this invention, there is provided an unvented zero clearance gas heater. The heater includes a completely enclosed combustion chamber having no flues or conduits connected to the combustion chamber to carry away the heat. A plenum chamber is in contact with the walls of the combustion chamber, and a fan is mounted in the plenum chamber to draw air into the plenum chamber for flow around the hot combustion chamber walls and to direct the heated air back into the room. The heater is designed so that the external surface thereof may be mounted adjacent to the combustible construction material of the walls in which the heater is mounted, thus providing the desired zero clearance.

DESCRIPTION OF THE PREFERRED EMBODIMENT

Figure 2:
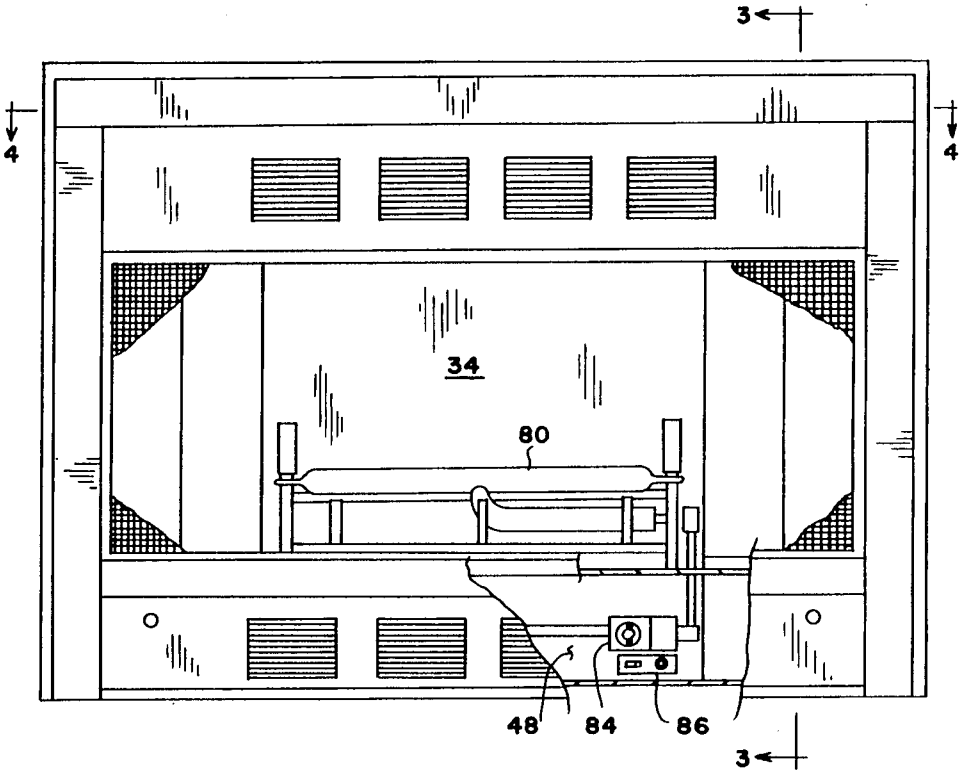
FIG. 2 is a front elevational view of the heater of the present invention.
Figure 1:
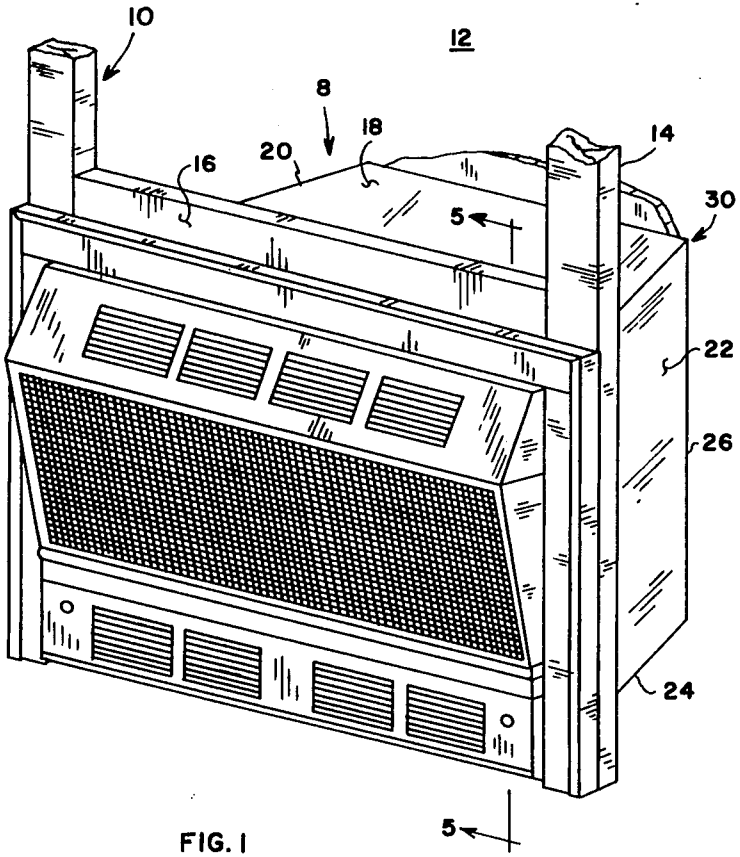
FIG. 1 is a pictorial view of the heater of the present invention installed in a wall and showing the wall board broken away to illustrate the zero clearance between the construction material and the heater.
Figure 5:
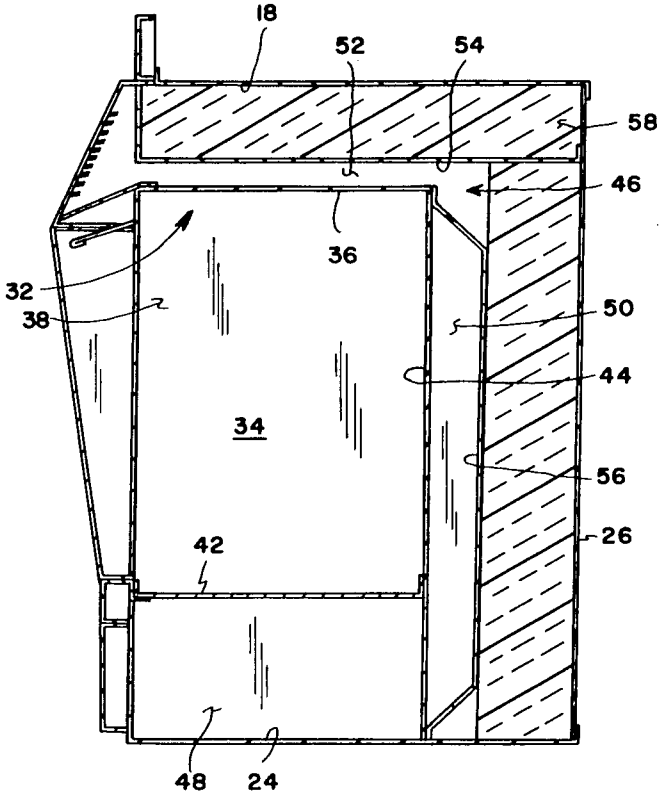
FIG. 5 is a sectional view taken along line 5—5 of FIG. 2 illustrating the outer enclosure for enclosing insulation in a space between top and rear walls of the combustion chamber's wall.

As seen in FIG. 1, a heater 8 is shown to be mounted in a wall 10 of a room 12. The heater is mounted in snug-fitting relation in an opening 14 provided in the combustible construction materials forming wall 10 to define a zero clearance relationship between the wall structure 16 (2×4 lumber, etc.) and the outer surfaces of panel members 18, 20, 22, 24, and 26, respectively, of heater 8. Members 18, 20, 22, 24, and 26, respectively, form the top, first vertical side, second vertical side, bottom, and back of an outer enclosure, generally designated by the numeral 30, of the heater. Enclosure 30 encloses, in spaced relation therewith, a second enclosure 32 (FIGS. 3, 4, and 5) which forms a combustion chamber 34. The combustion chamber of enclosure 34 is formed by top, first side, second side, bottom, and back walls 36, 38, 40, 42, and 44, respectively.

A plenum chamber, generally designated by the numeral 46, is defined by a bottom horizontal chamber section 48, a rear vertical chamber section 50, and an upper horizontal chamber section 52. Upper chamber section 52 is in communication with lower chamber section 48 by means of the rear vertical section 50. To form the chamber sections of the plenum chamber, upper horizontal panel 54 is disposed in spaced relation with and extends over the top combustion chamber wall 36 forming upper plenum section 52. Rear vertical section 50 is formed between back combustion chamber wall 44 and a back panel member 56. Lower plenum chamber section 48 is formed between bottom panel member 24 and the bottom combustion chamber wall 42.

When used in conjunction with the embodiment of FIGS. 1-5 wherein the heater is installed in typical home construction combustible materials, an insulation jacket including insulation sections 58 is enclosed between side panels or walls 20 and 38, upper panels or walls 18 and 54, and rear panels or walls 26 and 56. The insulation may be comprised of delta board mineral wool or other suitable insulation materials.

Figure 3:
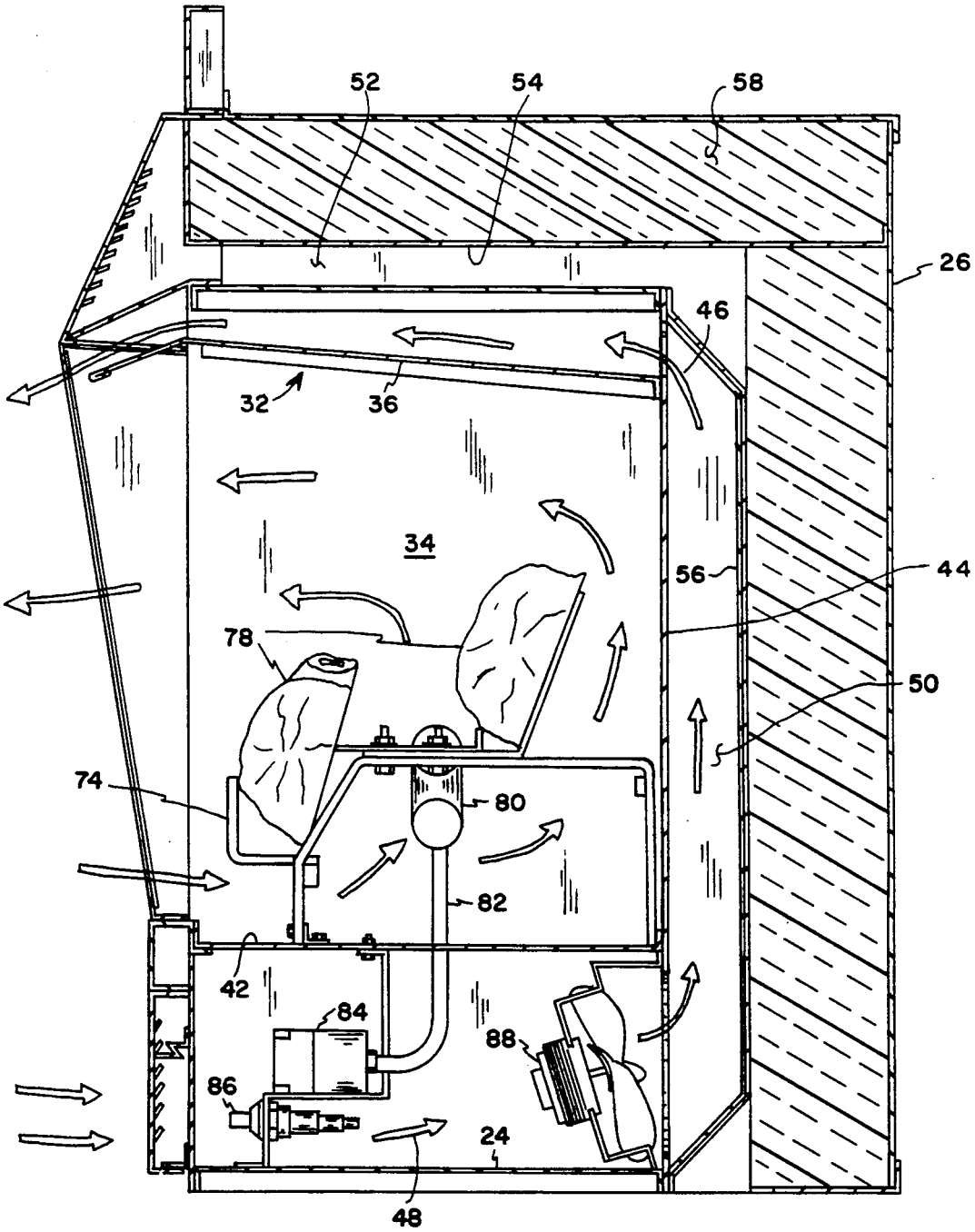
FIG. 3 is a sectional view taken along line 3—3 of FIG. 2.
Figure 4:
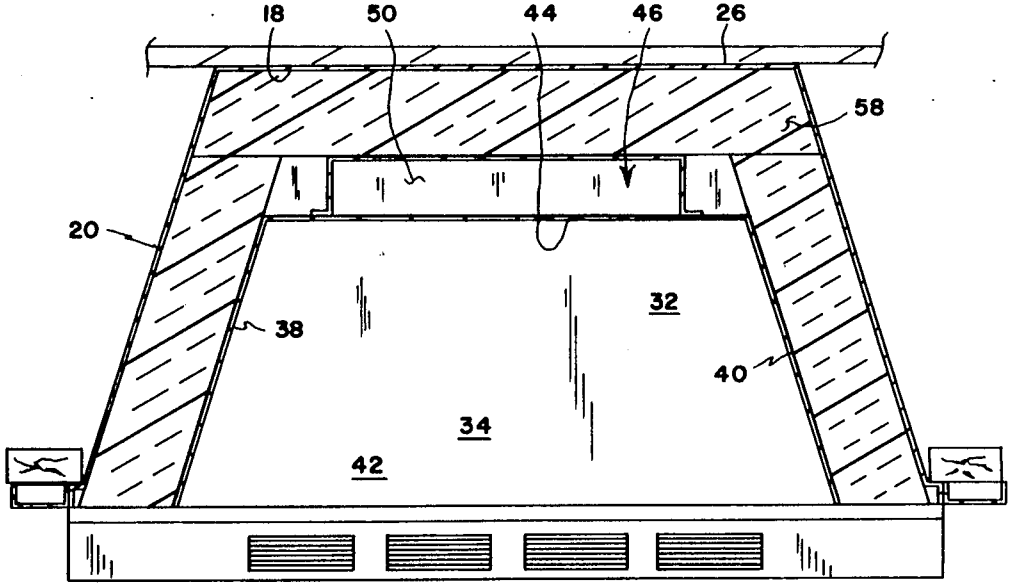
FIG. 4 is a sectional view taken along line 4—4 of FIG. 2 illustrating an outer enclosure for enclosing insulation in a space between the combustion chamber's vertical walls and the outer enclosure. The components of the combustion chamber have been omitted for clarity.

Combustion chamber 32 is shown in FIG. 3 to include a pair of supports 74 and 76 having gas logs 78 thereon. A gas burner manifold 80 is mounted in the combustion chamber and is connected to a source of gas (not shown) through a conduit 82. A control panel 84 is shown to control the gas supply to the manifold, and a piezo igniter 86 is shown for igniting the gas. A fan 88 is mounted in the lower section 48 of the plenum chamber to circulate air through the plenum chamber, around the combustion chamber walls, and into the room. The air is heated during its passage through the plenum chamber. Air entering the front of the heater supports combustion in the combustion chamber and is also permitted to flow back into the room.

Figure 7:
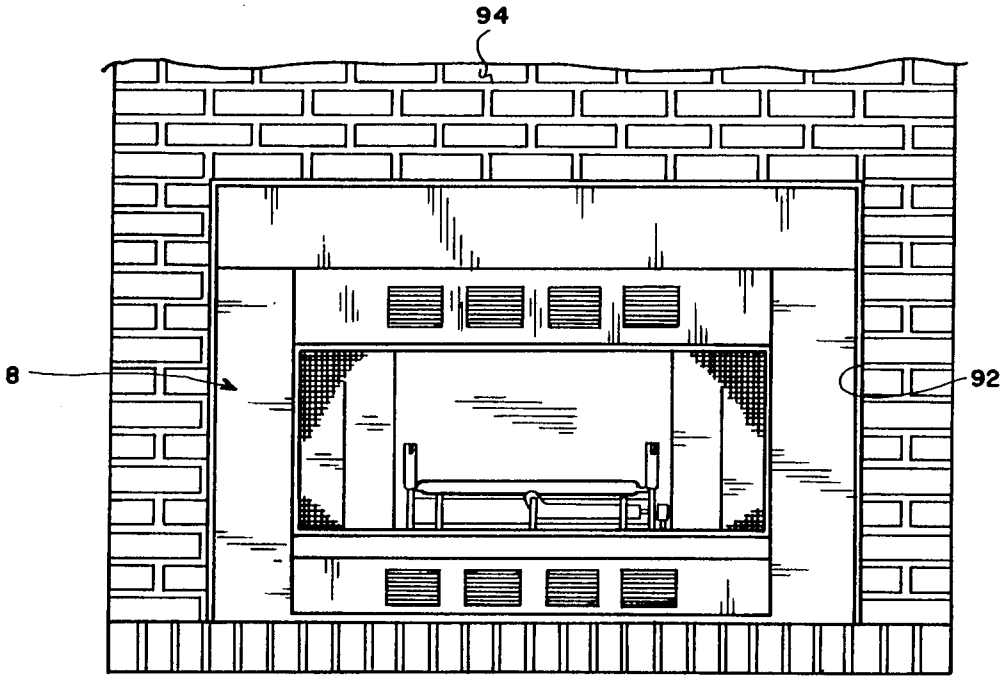
FIG. 7 is an elevational view of the heater of the present invention installed in the fireplace of FIG. 6.
Figure 6:
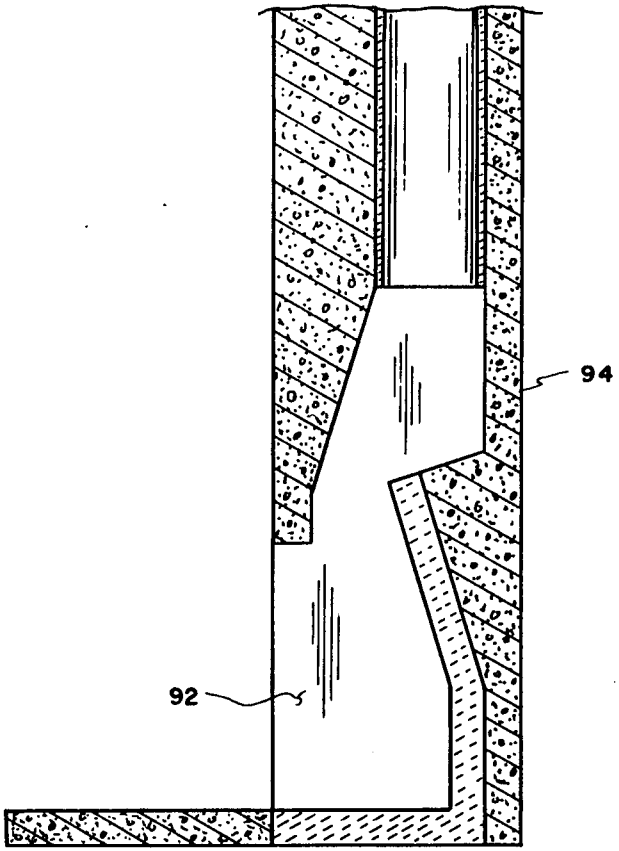
FIG. 6 is a sectional view of a typical fireplace in which the heater of the present invention may be installed.

FIGS. 6 and 7 illustrate heater 8 installed in an opening 92 of a fireplace 94 made of typical fire-proof materials. It is to be understood that when mounted in such existing fireplaces, the insulation discussed above is not required.

We claim:

1. An unvented fireplace heater for directing heated air into an enclosure comprising:

combustion means including a gas burner carried in said heater and disposed for communication with a source of gas;

an unvented combustion chamber defined by top, side, bottom, and rear walls and a forward closure member, said walls and forward closure member completely enclosing said combustion chamber, said forward closure member having opening means for directing primary air from said enclosure into said combustion chamber wherein a portion of said primary air supplies oxygen to said gas burner, and the remaining primary air is exhausted through said closure member through further opening means back into said enclosure after heating thereof by said combustion means;

means forming a plenum chamber having an inlet and an outlet, said means forming said plenum chamber including inner bottom, inner rear, and inner top walls which are common with the respective said bottom, rear, and top walls of said combustion chamber; and outer bottom, outer rear, and outer and top walls respectively disposed in spaced relation with said inner bottom, inner rear, and inner top walls, said plenum chamber being completely enclosed between said inlet and said outlet and sealed from said combustion chamber; and fan means for directing secondary air through said plenum chamber and around said bottom, rear, and top walls of said combustion chamber for heating of said secondary air and for directing the heated secondary air back into said enclosure independent of said primary air.

2. A heater as set forth in claim 1 wherein said combustion chamber is provided with gas logs disposed adjacent to said gas burner.

3. A heater as set forth in claim 2 including insulating means disposed in substantially surrounding relation with said combustion chamber.

4. A heater as set forth in claim 3 wherein said insulation means includes a jacket of insulating material disposed in spaced relation with said top, rear, and side walls of said combustion chamber.

5. A heater as set forth in claim 4 wherein said plenum chamber is disposed intermediate said jacket and said combustion chamber.

6. A heater as set forth in claim 5 including support means having an opening for receiving said heater therein.

7. A heater as set forth in claim 6 wherein said support means is a fireplace.

* * * * *